US008151760B2

(12) United States Patent
Hoefner

(10) Patent No.: US 8,151,760 B2
(45) Date of Patent: Apr. 10, 2012

(54) HIGH PRESSURE INJECTION ARRANGEMENT FOR AN INTERNAL COMBUSTION ENGINE WITH DIRECT INJECTION

(75) Inventor: Dirk Hoefner, Wellheim (DE)

(73) Assignee: Audi AG, Ingolstadt (DE)

( * ) Notice: Subject to any disclaimer, the term of this patent is extended or adjusted under 35 U.S.C. 154(b) by 0 days.

(21) Appl. No.: 12/500,435

(22) Filed: Jul. 9, 2009

(65) Prior Publication Data

US 2010/0006060 A1 Jan. 14, 2010

(30) Foreign Application Priority Data

Jul. 9, 2008 (DE) ..... 10 2008 032 385

(51) Int. Cl.
*F02B 75/00* (2006.01)
*F02M 61/14* (2006.01)

(52) U.S. Cl. ..... 123/294; 123/470

(58) Field of Classification Search ..... 123/294, 123/456, 467–472, 509
See application file for complete search history.

(56) References Cited

U.S. PATENT DOCUMENTS

| | | | | |
|---|---|---|---|---|
| 5,671,715 | A * | 9/1997 | Tsuzuki | 123/467 |
| 5,785,024 | A * | 7/1998 | Takei et al. | 123/470 |
| 5,954,343 | A * | 9/1999 | Sumida et al. | 277/434 |
| 6,021,760 | A * | 2/2000 | Boecking | 123/467 |
| 6,085,719 | A * | 7/2000 | Heinz et al. | 123/300 |
| 6,168,132 | B1 * | 1/2001 | Frank et al. | 251/33 |
| 6,178,950 | B1 * | 1/2001 | Stockner et al. | 123/470 |
| 6,199,533 | B1 * | 3/2001 | Morris et al. | 123/299 |
| 6,283,094 | B1 * | 9/2001 | Ogata | 123/467 |
| 6,334,433 | B1 * | 1/2002 | Sumida et al. | 123/470 |
| 6,390,066 | B1 * | 5/2002 | Drummer et al. | 123/467 |
| 6,536,413 | B2 * | 3/2003 | Mori | 123/467 |
| 6,648,298 | B2 * | 11/2003 | Souma et al. | 251/129.21 |
| 6,899,087 | B2 * | 5/2005 | Norgauer | 123/470 |
| 7,201,663 | B2 * | 4/2007 | Menosky | 464/133 |
| 7,293,550 | B2 * | 11/2007 | Beardmore | 123/470 |
| 7,373,925 | B2 * | 5/2008 | Reiter et al. | 123/470 |
| 7,412,970 | B2 * | 8/2008 | Apel et al. | 123/470 |
| 7,516,735 | B1 * | 4/2009 | Doherty et al. | 123/468 |
| 7,690,357 | B2 * | 4/2010 | Fujimoto et al. | 123/467 |
| 2001/0032612 | A1 * | 10/2001 | Welch et al. | 123/294 |
| 2004/0060538 | A1 * | 4/2004 | Togashi et al. | 123/294 |

FOREIGN PATENT DOCUMENTS

| | | | |
|---|---|---|---|
| DE | 10038763 | A1 | 2/2002 |
| DE | 69711133 | T2 | 8/2002 |
| DE | 10338715 | A1 | 4/2005 |

* cited by examiner

*Primary Examiner* — John T. Kwon
*Assistant Examiner* — Johnny H Hoang
(74) *Attorney, Agent, or Firm* — Novak Druce + Quigg LLP

(57) ABSTRACT

The invention relates to a high pressure injection arrangement for an internal combustion engine with direct injection, with an injection valve and a support element, which supports the injection valve in the installed state on a seat of an internal combustion engine. It is provided that a spring element is arranged between the injection valve and the support element.

8 Claims, 2 Drawing Sheets

HIGH PRESSURE INJECTION ARRANGEMENT FOR AN INTERNAL COMBUSTION ENGINE WITH DIRECT INJECTION

The invention relates to a high pressure injection arrangement for an internal combustion engine with direct injection with an injection valve and a support element, which supports the injection valve in the installed state on a seat of an internal combustion engine.

BACKGROUND OF THE INVENTION

High pressure injection arrangements of internal combustion engines with direct injection, which have injection valves based on solenoid valve technology, develop high momenta during operation by the solenoid striking its end stops when the valve opens and closes, momenta that are transferred via the housing of the injection valve and the support element to the internal combustion engine and thus result in a noise emission that is perceptible by humans. In particular by reflection of free, oscillating surfaces in or on the cylinder head of the internal combustion engine, thus excited sound pulses that are very readily perceptible by humans are emitted. Because of the high opening and closing frequency of such injection valves, this sound frequency is in a relatively high frequency range that is considered to be very unpleasant to the human ear. Moreover, a clarion, mechanical striking noise, a "ticking," is perceptible. To minimize this undesirable sound pulse, it is known to provide elastic arrangements in the area in which the injection valve is supported on the cylinder head. For example, an arrangement in which a support element, namely a seat ring, supports the injection valve in the cylinder head is known from EP 1 134 406 B1. In the arrangement that is described there, it is disadvantageous that the seat ring and the spring element are spaced far apart from one another and that the bow-shaped spring element is suspended in a ring around the housing, i.e., ultimately provides no effective momentum damping but rather serves primarily as a fastening device. The latter, in particular in the radial respect, claims considerable installation space and requires a design of the spring element in the area of an electric connection and/or the connection of a fuel line in the end area of the injection valve. In particular, in this connection, the actual momentum transfer via the seat ring to the cylinder head is not effectively suppressed.

The object of the invention is to provide a high pressure injection arrangement that avoids the above-mentioned drawbacks and offers as complete elimination as possible of mechanical momentum input that leads to undesirable acoustic phenomena, due in particular to solid-borne sound conduction or excitation of oscillating surfaces in the engine block, in particular the cylinder head of the internal combustion engine.

SUMMARY OF THE INVENTION

In this way, a high pressure injection arrangement for an internal combustion engine with direct injection is proposed with an injection valve and a support element that supports the injection valve in the installed state on a seat of an internal combustion engine. In this connection, it is provided that a spring element is arranged between the injection valve and the support element. In this connection, the injection valve is held in a support element that supports the injection valve in its installed state on the seat of the internal combustion engine that is intended for it. A spring element is arranged between the injection valve and the support element. Accordingly, unlike in the prior art, the momentum that is produced by the solenoid valve of the injection valve is not transferred from the housing of the injection valve directly to the support element, as a result of which the damping or even the extinction of the momentum can take place only to the extent allowed by the material and design of the support element, but rather the momentum is first transferred to a spring element that is arranged between the support element and the injection valve and from the latter to the support element. In this way, a considerable portion of the momentum in the spring element is already consumed. The support element is therefore only affected by momentum to a far lesser extent than in the prior art, so that its share of the residual momentum to be damped is relatively small.

The spring element is preferably a spring washer. In this connection, the spring element is designed essentially flat, specifically, as a spring washer, here a spring washer being also defined as a lock washer, i.e., a spring washer with an essentially central opening.

It is further provided in one embodiment that the spring washer has an inside ring zone and an outside ring zone, with the inside ring zone resting on the injection valve in a first contact area and the outside ring zone resting on the support element in a second contact area. The first contact area is consequently the contact area in which the injection valve is in close contact with the inside ring zone of the spring washer, while the second contact area is the one in which the outside ring zone contacts the support element. The spring washer is consequently designed as a ring, namely as a lock washer, which is centrally penetrated by the injection valve, which is made, for example, stepped. In this connection, the inside ring zone rests on the injection valve and thus forms the first contact area. The outside ring zone rests on the support element and thereby mediates the support of the injection valve via the spring washer on the support element in the second contact area. It is essential in this connection that the injection valve not rest directly on the support element and preferably also in such a way that the first contact area and the second contact area, viewed in axial extension of the injection valve, are not aligned. In this way, solid-borne sound transfer or momentum input by the injection valve into the cylinder block, namely via the support element, is very effectively prevented.

The first contact area is preferably a first line contact area. By means of the line contact area, an essentially pure line-shaped contact formation can be achieved, so that a large-area contact is avoided, and a geometrically exactly defined momentum input into the spring washer takes place via the spatially very concentrated local pressure that develops in this connection when the momentum strikes the line contact area.

The second contact area is especially preferably a second line contact area. In this connection, what is stated for the first line contact area applies accordingly.

In another, especially preferred design, the first contact area is at a radial distance from the second contact area. In this respect, a kind of lever by which the injection valve is kept elastic/suspended relative to the injection valve, i.e., can spring in and out in particular in the axial direction, is formed between the first contact area and the second contact area, in particular namely the first line contact area and the second line contact area. In this way, direct momentum input by the injection valve onto the support element and via the latter into the cylinder head is avoided. By this arrangement, a spring-mass system is also formed, by which any momentum can be degraded as a damped oscillation.

In one embodiment, the spring element consists of steel. In particular, the use of commonly used spring steel or else ordinary steel, for example a washer, is considered. For this application, steel has very good elasticity and strength values.

It is preferably provided that the support element consists of plastic. In this way, self-damping of the support element can be produced, namely by the selection of the plastic material, as a result of which the residual momentum that is still introduced into the support element can be advantageously damped, so that the latter is not introduced into the cylinder head (or only to a very small extent). The embodiment of a plastic support element without the spring element according to the invention would be conceivable in principle, but in this connection the support element would have to be designed especially large to achieve an only approximately similarly good damping value, which could produce, on the one hand, installation space problems, and, on the other hand, accuracy problems, in particular in the assembly and in the achievable seat of the internal combustion engine; such a support element, taken by itself, would not be able to achieve the proposed high momentum damping.

In another embodiment, the support element is a cage element. Thus, it is meant that the support element encompasses the injection valve at least in certain areas. In particular, it is provided to design the cage element such that the support element has a seat ring that locks in support element holding devices of the injection valve, for example, with clips or clip arms that are extended on the cage element on the outside in the axial direction of the injection valve. Thus, a very simple and reliable mounting of the support element on the injection valve can be achieved; in particular, the injection valve can be preassembled with the support element and the spring washer or the spring element stored therein and is thus available as a subassembly for installation in the internal combustion engine.

DETAILED DESCRIPTION OF THE PREFERRED EMBODIMENTS OF THE INVENTION

Figure 1:
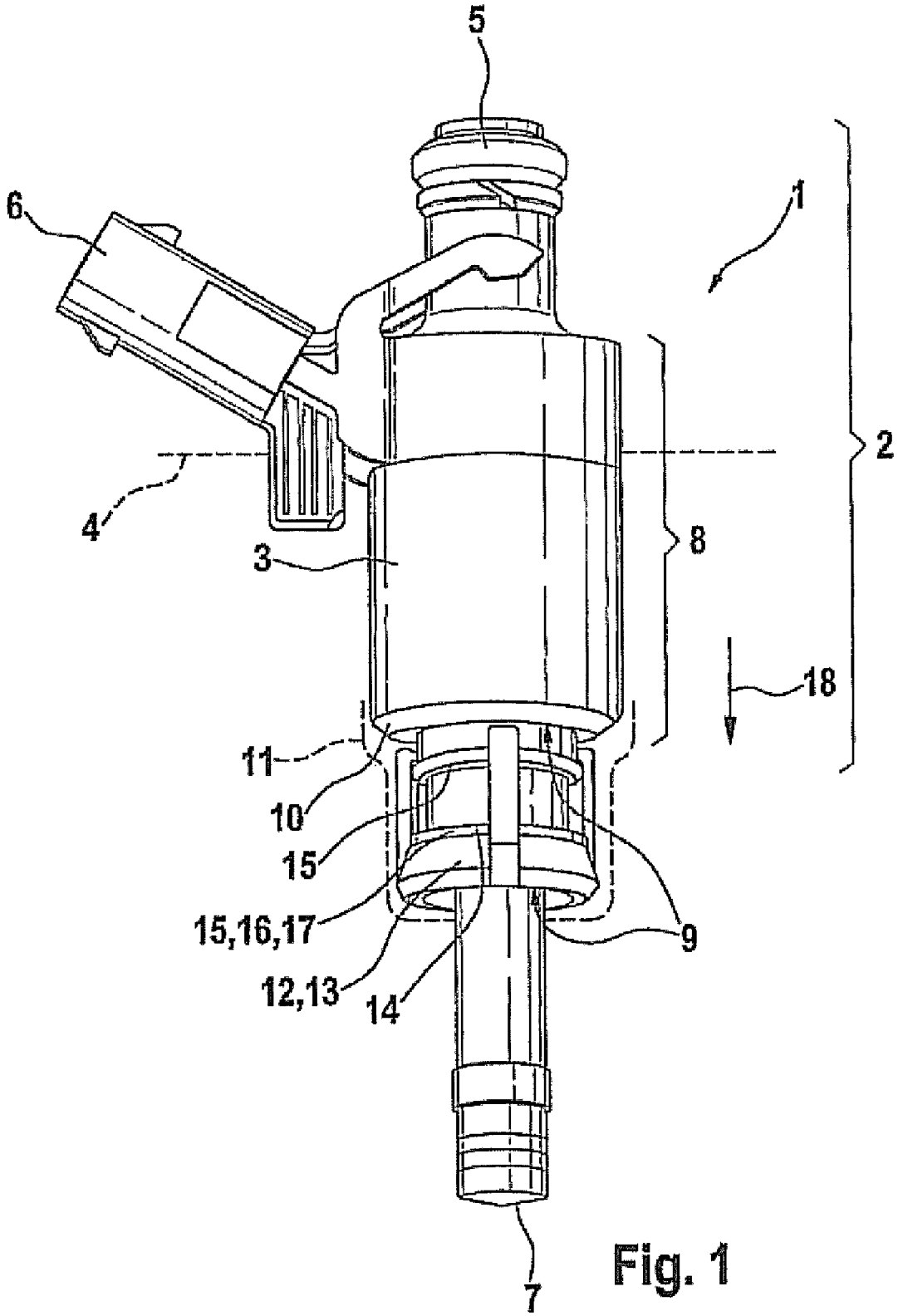
FIG. 1 shows a three-dimensional visualization of the injection valve.

FIG. 1 shows an injection valve 1 for a high pressure injection unit of a motor vehicle, not shown, with a housing 3 that is designed as a stepped cylinder 2 in the broadest sense, and said housing is used in, for example, a belt line 4 in an engine of an internal combustion engine, not shown, in particular in the area of a cylinder head (not shown in FIG. 1). Above the belt line 4, the injection valve 1 has a fuel connection 5 as well as an electric connection 6 for connection to the fuel supply and control system of the motor vehicle. The housing 3 is tapered on the end that faces away from the fuel connection 5, in multiple stages up to the formation of an injection nozzle 7, which introduces the fuel to be injected into the combustion chamber of the internal combustion engine. In this connection, the housing 3 can be divided into the valve base 8 and then, toward the injection nozzle, two ring stages 9 for forming the stepped cylinder 2, whereby the ring stages 9 have support surfaces 10 pointing in the direction toward the injection nozzle 7. On the support surfaces 10, the attachment of the injection valve 1 to a seat 11 of the internal combustion engine is carried out. In the area of the ring stage 9 that lies closest to that of the injection nozzle 7, the injection valve 1 is held by a support element 12 that surrounds the housing 3 like a cage element 13 in this area. In this way, a spring element 15, which surrounds the injection valve 1 like a ring in the area of the ring element 9 that is surrounded by the cage element 13 in the form of a spring washer 16, in particular a lock washer 17, is arranged between the injection valve 1 and the support element 12 to form an elastic bearing 14. In this way, a momentum 18 that has developed during the operation of the injection valve 1 by the electromagnets of the injection valve 1, not shown, and that would be introduced in the axial direction of the injection valve 1 via the seat 11 into the cylinder head, not shown here, is elastically absorbed.

Figure 2:
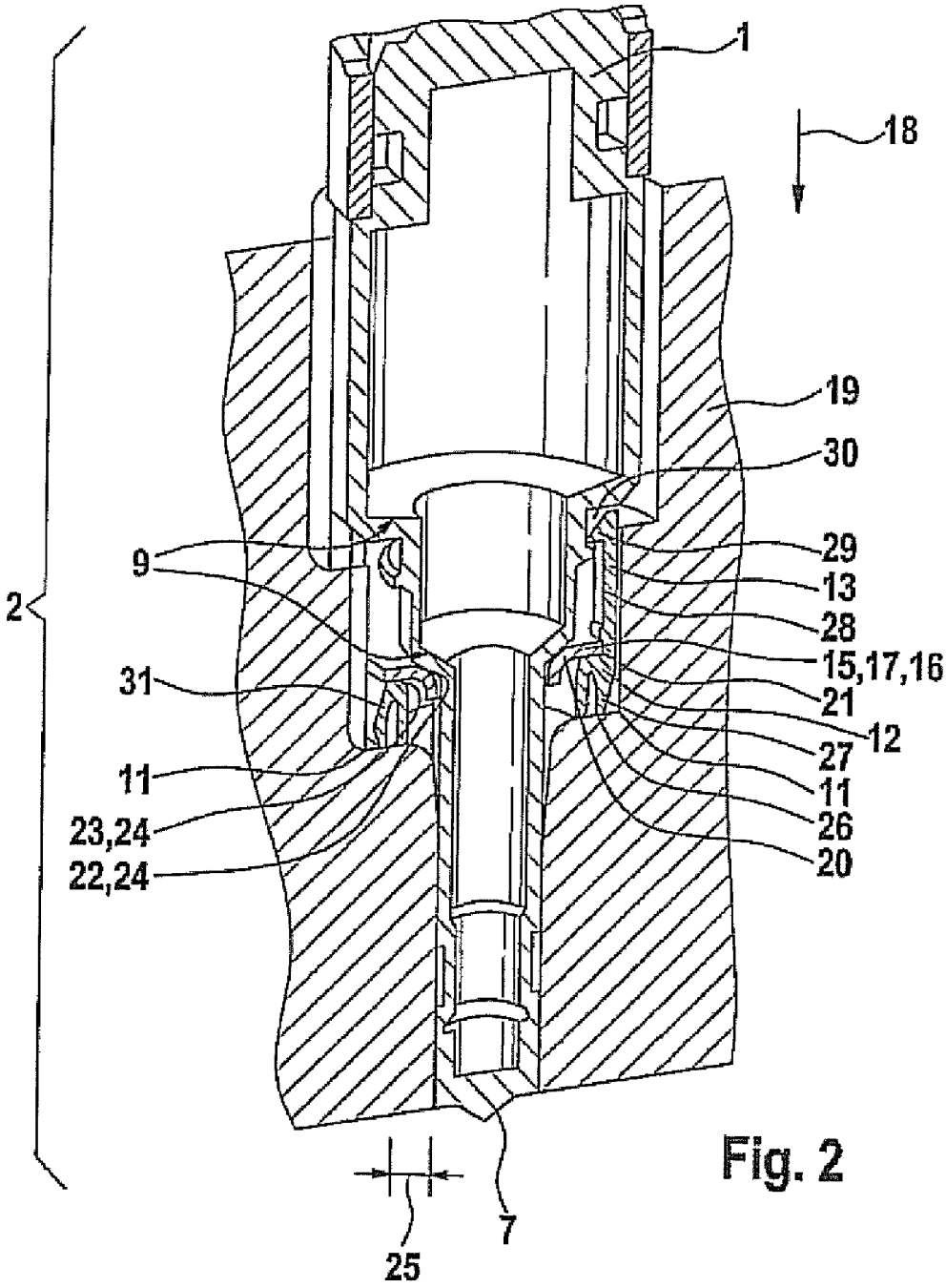
FIG. 2 shows a sectional view of the injection valve in the installed state.

FIG. 2 shows sections of the injection valve 1 in cross-section how the valve is installed in the seat 11 of a cylinder head 19 of the internal combustion engine in the installation position. The injection valve 1 is designed as a stepped cylinder 2, with the ring stages 9 being present with diameter tapering in the direction toward the injection nozzle 7. The ring stage 9 that lies closest to the injection nozzle 7 presses the spring element 15, namely the lock washer 17. In this connection, the lock washer 17, namely the spring washer 16, has an inside ring zone 20 and an outside ring zone 21. In this connection, the outside ring zone 21 rests on the support element 12, while the inside ring zone 20 rests on the injection valve 1. As it rests against the injection valve 1, the inside ring zone 20 forms a first contact area 22, and while it rests against the support element 12, the outside ring zone 21 forms a second contact area 23. Both the first contact area 22 and the second contact area 23 are in each case line contact areas 24. This means that an essentially line-shaped arrangement exists. In this connection, the first contact area 22 and the second contact area 23 are at a radial distance 25 from one another. The spring element 15 is consequently held between the first contact area 22 and the second area 23 like a rotating lever, and together with the mass of the injection valve 1, a spring-mass system is created, by which the momentum 18, which is transferred in the direction toward the injection nozzle 7 from the injection valve 1 to the seat 11 in the cylinder head 19, is effectively damped. Here, as described, the support element 12 is designed as a cage element 13, whereby in the area of the seat 11, namely on a stepped support surface 26 in the cylinder head 19, on which it is supported, it is designed as a seat ring 27, which encompasses the injection valve 1 in a circular manner in the area of the ring stage 9 that lies closest to that of the injection nozzle 7. The seat ring 27 has axial struts 28 that are designed to extend from the seat ring 27 in the axial extension of the injection valve 1 and that at the injection valve 1 run in the direction away from the injection nozzle 7 up to the second ring stage 9. The latter have snap hooks 29 that engage in a circumferential groove 30 at the injection valve 1 or in correspondingly shaped recesses at the injection valve 1 and in this way attach the support element 12 to the injection valve 1. The shape of the cage element 13 is created by this design. The seat ring 27, for its part, has a structure that is formed essentially as an inverted U 31 in the direction toward the stepped support surface 26, as a result of which in turn an improved, elastic support of the support element 12 on the stepped support surface 26 is produced. The support element 12 is preferably made from a plastic, and the spring element 15 is preferably made from steel. In combining these materials, advantageous, very good momentum and oscillation damping can be achieved, so that the momentum 18 is not transferred or is transferred only to a very small extent to the cylinder head 19.

The invention claimed is:

1. An assembly mountable on the housing of a fuel injection valve insertable into an opening in an engine block of an internal combustion engine, for seating said injection valve in an enlarged section of said engine opening, comprising:

a first annular member provided with an opening for receiving a portion of said injection valve housing therethrough, disposable on an annular support surface of said enlarged section of said engine block opening, and having at least two circumferentially spaced arm portions provided with protruding segments insertable in an annular recess in said injection valve housing, disposed coaxially therewith; and a second annular member provided with an opening for receiving a portion of said injection valve housing therethrough, including an outer, annular portion disposable on an annular seating surface of said first annular member, and an inner, annular portion engageable in supporting relation by an annular seating surface of said injection valve housing, disposed coaxially with and spaced axially from said annular recess of said injection valve housing.

2. An assembly according to claim 1 wherein said first annular member is formed of a flexible material and said second annular member is formed of a rigid material.

3. An assembly according to claim 1 wherein said first annular member is formed of a plastic material and said second annular member is formed of a metallic material.

4. An assembly according to claim 1 wherein said protruding segments of said arm portions of said first annular member are functional to snap-fit into said annular recess of said injection valve housing.

5. An assembly according to claim 1 wherein said outer annular portion of said second annular member is substantially planar and said inner annular portion of said second annular member is curved.

6. An assembly according to claim 5 wherein said inner annular portion of said second annular member is engaged by a frusto-conically configured surface of said injection valve housing when said assembly is mounted on said housing.

7. An assembly according to claim 1 wherein said first annular member is provided with an annular recess providing two annular portions engaging said annular support surface of said enlarged section of said engine block opening when said first annular member is disposed therein.

8. An. assembly according to claim 7 wherein said first annular member is formed of a flexible plastic and said annular member is formed of a metal.

* * * * *